US012710041B2

(12) United States Patent
Nübl et al.

(10) Patent No.: US 12,710,041 B2
(45) Date of Patent: Aug. 18, 2026

(54) ECCENTRIC SCREW PUMP WITH MAGNETIC COUPLING

(71) Applicant: Netzsch Pumpen & Systeme GmbH, Waldkraiburg (DE)

(72) Inventors: Philipp Nübl, Gras Bahnhof, DE (US); Stefan Schöberl, Buchbach (DE); Thomas Schmitt, Lohkirchen (DE); Thomas Haslberger, St. Wolfgang (DE); Stefan Weigl, Mühldorf (DE); Dominik Sinseder, Dorfen (DE); Sophia Laraßer, St. Wolfgang (DE)

(73) Assignee: NETZSCH Pumpen & Systeme GmbH, Selb (DE)

( * ) Notice: Subject to any disclaimer, the term of this patent is extended or adjusted under 35 U.S.C. 154(b) by 0 days.

(21) Appl. No.: 18/762,832

(22) Filed: Jul. 3, 2024

(65) Prior Publication Data

US 2025/0012277 A1 Jan. 9, 2025

(30) Foreign Application Priority Data

Jul. 6, 2023 (DE) ..... 10 2023 117 802.4

(51) Int. Cl.
*F04C 15/00* (2006.01)
*F04C 2/107* (2006.01)

(52) U.S. Cl.
CPC ..... *F04C 15/0069* (2013.01); *F04C 2/1073* (2013.01); *F04C 15/0038* (2013.01); (Continued)

(58) Field of Classification Search
CPC ..... F04C 15/0069; F04C 2/1073; F04C 15/0038; F04C 15/0065; F04C 15/0096; (Continued)

(56) References Cited

U.S. PATENT DOCUMENTS 6,539,926 B2 * 4/2003 Hakansson ..... F04C 15/0069 123/495
7,553,139 B2 * 6/2009 Amburgey ..... F04C 15/0069 418/152

FOREIGN PATENT DOCUMENTS

EP 0778658 A1 * 6/1997 ..... F04D 15/0094
EP 2944819 B1 7/2017

OTHER PUBLICATIONS

Chinese Patent Publication and Machine Translation for CN 1111350656 A; 1st Inventor: Wu; Title: A High Reliable Sealing of Submarine Sewage Pump; Published Jun. 30, 2020. (Year: 2020).*

* cited by examiner

*Primary Examiner* — Mary A Davis
(74) *Attorney, Agent, or Firm* — Whitmyer IP Group LLC

(57) ABSTRACT

An eccentric screw pump with a rotor of a pump drive shaft circling essentially about a fixed axis relative to a stator in a bearing block, which pump drive shaft is rotationally driven by a motor drive shaft of a motor, a power train and a screw conveyor, which revolves in a rotating-oscillating manner in a screw flight of the stator, wherein the power train provides the screw conveyor with its drive torque and the power train adapts the differences of the motion sequences of the screw conveyor and of the pump drive shaft. There is thereby an air gap between the motor drive shaft and the pump drive shaft, wherein the motor drive shaft supports a motor-side coupling half and the pump drive shaft supports a pump-side coupling half, which are connected to one another in a torque-transmitting manner by means of magnetic forces across the air gap, wherein the air gap is penetrated by a seal, which hermetically separates the motor region from the rest of the eccentric screw pump.

14 Claims, 4 Drawing Sheets

(52) U.S. Cl.
CPC ..... *F04C 15/0065* (2013.01); *F04C 15/0096* (2013.01); *F04C 2240/50* (2013.01); *F04C 2240/60* (2013.01); *F04C 2240/80* (2013.01); *F04C 2240/81* (2013.01)

(58) Field of Classification Search
CPC ..... F04C 2240/50; F04C 2240/60; F04C 2240/80; F04C 2240/81
See application file for complete search history.

ECCENTRIC SCREW PUMP WITH MAGNETIC COUPLING

TECHNICAL FIELD

The present invention relates to an eccentric screw pump with a rotor of a pump drive shaft circling essentially about a fixed axis relative to a stator in a bearing block. The pump drive shaft is rotationally driven by the motor drive shaft of a motor. The eccentric screw pump has a power train and a screw conveyor, which revolves in a rotating-oscillating manner in a screw flight of the stator. The power train thereby provides the screw conveyor with its drive torque and the power train adapts the differences of the motion sequences of the screw conveyor and of the pump drive shaft.

BACKGROUND

Eccentric screw pumps are known as such from the prior art.

EP2944819B1 relates to an eccentric screw pump, comprising a rotor, which extends along a rotor longitudinal axis from a drive end to a free end, a stator housing with an interior space, which extends along the longitudinal axis from a stator inlet opening to a stator outlet opening and which is formed to receive the rotor, a drive motor with a drive shaft, which is coupled to the rotor for transmitting a torque, a first cardan joint, which is inserted into the transmission of the torque between the drive shaft and the rotor, and a stator output flange, which is arranged downstream from the rotor in the flow direction.

The motor-side end of the eccentric screw pump is sealed by means of a mechanical seal—in the manner as it can frequently be encountered in the case of eccentric screw pumps.

One disadvantage of this type of seal is that critical and in particular irritating or toxic substances cannot be pumped or can be pumped only to a limited extent. This is so because even when working properly, mechanical seals always have a certain leakage—at least a small leakage flow of the fluid to be sealed reaches into the sealing gap, develops a lubricating effect there for the most part, before it evaporates and leaves the sealing gap in a gaseous manner, so that the seal appears to seal perfectly.

SUMMARY

The object on which the invention is based is to provide an eccentric screw pump, which can also pump critical, in particular toxic irritating or environmentally harmful fluids, without any fear of contaminations or emissions.

The underlying object is solved by means of an eccentric screw pump with a rotor, which consists of a pump drive shaft, which circles essentially about a fixed axis relative to a stator in a bearing block. It is driven in a rotating manner by the motor drive shaft of a motor. The pump drive shaft is connected via a power train to a screw conveyor, which revolves in a rotating-oscillating manner in a screw flight of the stator. The power train thereby provides the screw conveyor with its drive torque. The power train simultaneously adjusts the differences of the motion sequences of the screw conveyor and of the pump drive shaft.

According to the invention, the eccentric screw pump is characterized in that there is an air gap between the motor drive shaft and the pump drive shaft and that the motor drive shaft supports a motor-side coupling half and the pump drive shaft supports a pump-side coupling half, which are connected to one another in a torque-transmitting manner by means of magnetic forces across the air gap. The air gap is thereby penetrated by a seal, which hermetically separates the motor region from the rest of the eccentric screw pump.

The motor drive shaft, i.e., the motor shaft used to drive the eccentric screw pump, and the pump drive shaft are not physically connected directly to one another.

The gap referred to as air gap between the motor-side coupling half and the pump-side coupling half can be filled by air or also a different medium, such as preferably the fluid to be pumped. The medium should thereby not contain any or essentially no ferromagnetic material so as not to hinder the transmission of the magnetic forces across the air gap. The air gap has to be embodied sufficiently large, so that the two coupling halves of the magnetic coupling do not actually come into contact with the seal penetrating the air gap even under the impact of vibrations or shocks. Detrimental frictional forces and a mechanical wear are thus prevented.

The air gap is penetrated by the seal, for example in the form of a cylindrical air separating can in order to hermetically seal the motor region from the rest of the eccentric screw pump, so that the pumped fluid cannot reach into the motor region.

The seal should thereby not contain any or essentially no ferromagnetic material so as not to hinder the transmission of the magnetic forces across the air gap and through the seal.

It is a further advantage of the eccentric screw pump, which is embodied according to the invention that its seal towards the motor shaft is essentially wear-free even under the impact of abrasive media, which avoids or extends maintenance intervals and which is beneficial for the service life.

The seal can advantageously be embodied as preferably cylindrical air separating can, which is held on the bearing block with its open side and which forms a cavity, which protrudes beyond the bearing block and which receives the pump-side coupling half.

The cylindrical air gap can has a cavity, which receives the pump-side coupling half, so that said air separating can be arranged in a space-saving manner and the construction according to the invention can be set up on already available bearing blocks, without having to make extensive structural changes to said bearing blocks. Conventional eccentric screw pumps can thus be equipped with the construction according to the invention in a simple way.

The motor-side and the pump-side coupling half are advantageously designed such and are equipped magnetically in such a way that they revolve synchronously with one another (in the interference-free nominal operation of the eccentric screw pump), preferably without any slip.

As soon as slip occurs, high eddy currents are induced by the strong magnets of the two coupling halves of the magnetic coupling, which would thermally destroy the magnetic coupling quite quickly.

The eccentric screw pump can advantageously be equipped with a thermal sensor or, not preferably, with another slip detector, which triggers an alarm and/or takes slip-ending measures, as soon as slip occurs between the coupling halves.

It is ensured with this that the eccentric screw pump is not damaged due to slip-related overheating in the region of the coupling halves in the case of overloading or even in the event that the eccentric screw thereof gets stuck unintentionally.

The pump-side coupling half can advantageously be cooled by means of the fluid, which is pumped by the eccentric screw pump, namely ideally by means of direct contact.

The pump drive shaft can advantageously support a pump means, preferably on its front end region facing away from the screw conveyor, more preferably a pump wheel, ideally a centrifugal pump wheel, which drives a flow through the air gap.

A flow through the air gap, which can be used for cooling or for rinsing purposes, is thus at least partially created at the pump drive shaft by means of the pump means, such as the centrifugal pump wheel.

The flow through the air gap can be driven or generated, respectively, in a supporting manner by the pump means or essentially solely by means of the pump means.

The pump drive shaft can advantageously be supported on rolling bearings and/or slide bearings, preferably in the bearing block.

Rolling bearings have the advantage that they can be flown through more easily in the transverse direction, so that fluid can more easily reach the pump-side coupling half to be cooled or can be discharged from it.

The rolling bearings can be embodied as ceramic bearings, so that the service life is extended and the maintenance effort compared to metallic bearings is reduced, in particular also under the impact of abrasive fluids.

A continuous, tubularly closed cooling duct can advantageously be provided, which reaches from the high pressure region, preferably from the free front end of the screw conveyor, all the way into a region of the magnetic coupling, so that the higher pressure drives a flow of the pumped fluid from the high pressure region into the region of the magnetic coupling.

The pumped fluid is driven from the high pressure region into the region of the magnetic coupling with low pressure by means of the cooling duct between the high pressure region and the region of the magnetic coupling with lower pressure, so that a cooling flow and/or a cleaning flow, which prevents an overheating of the magnetic coupling and thus extends the service life of the eccentric screw pump, is thereby created by means of the rotor.

The cooling duct can run, for example, through the entire rotor, comprising pump drive shaft, power train and screw conveyor, along an axis of symmetry, for instance along the central longitudinal axis in the region of the screw conveyor (which does not necessarily have to be straight), wherein the cooling duct is produced by means of a conventional drilling method through the entire rotor or by using a 3D printing method. In the case of the 3D printing method, the entire rotor with the cooling duct running therein is printed out by means of a 3D printer, wherein the material used for printing is sintered after the printing in order to produce a rotor according to the invention.

The bearing block or drive region, respectively, can advantageously have at least one connection, via which an auxiliary fluid can be introduced. It will preferably have at least one further connection, via which the auxiliary fluid can be discharged again.

The introduction of the auxiliary fluid into the drive region and the discharge of the auxiliary fluid is therefore made possible by means of the two connections. The auxiliary fluid can be, for example, a fluid for rinsing and cleaning the bearing block or drive region, respectively, and the magnetic coupling, wherein the fluid for rinsing and cleaning is introduced by means of the first connection and is discharged by means of the second connection, for example when changing the pumping fluid or during maintenance operations. A rinsing of the drive region can be required, for example, in order to prevent a strong sedimentation by means of the pumped fluid within the drive region. The auxiliary fluid can alternatively also be an additional fluid for cooling in order to additionally cool the drive region and the magnetic coupling. If longer system downtimes occur in the case of a chemically highly-aggressively pumped fluid, the auxiliary fluid can, in further alternative, also be a neutralizing agent, which is introduced into the drive region in order to neutralize the rest of the chemically highly-aggressively pumped fluid in the drive region and to thus prevent a damage caused by the fluid.

The region of the bearing block guiding auxiliary fluid can advantageously be separated from the region guiding fluid to be pumped by means of a contact seal.

The region with the auxiliary fluid is thus separated from the region with the fluid to be pumped by means of the contact seal. This can be advantageous in particular when pumping toxic-abrasive products or highly toxic products as fluid to be pumped. The contact seal can be embodied in the form of a mechanical seal. For the most part, mechanical seals have a small leakage or leakiness, respectively, so that only the small leakage of the fluid to be pumped has to be discharged by means of the rinsing fluid, which is non-abrasive and non-toxic as such.

The auxiliary fluid can advantageously be supplied to the bearing block or drive region, respectively, and/or can be guided in it so that the bearing block or the drive region, respectively, can be cleaned without disassembly.

The drive region can thus be cleaned by means of auxiliary fluid for rinsing, without disassembling the eccentric screw pump.

A further object of the invention is an eccentric screw pump with a screw conveyor, which is rotationally driven by the motor drive shaft of a motor and thereby revolves in a rotating-oscillating manner in a screw flight of the stator. The screw conveyor is thereby connected directly to a pump-side coupling half and cooperates with a motor-side coupling half, wherein the two coupling halves are connected to one another in a torque-transmitting manner by means of magnetic forces across an air gap (in the above-defined sense) permanently separating them, and the air gap is formed and dimensioned so that it tolerates, preferably in a contact-free manner, the rotating-oscillating movement, which the screw conveyor impresses upon the pump-side coupling half.

An advantage of such an eccentric screw pump lies in that the screw conveyor is connected directly to the pump-side coupling half, so that no power train and no sliding or rolling bearing has to be used in the bearing block in order to adjust the rotating-oscillating movement of the screw conveyor. The eccentric screw pump can thus be embodied much more compactly.

The air gap between the two coupling halves is thereby formed and dimensioned so that it tolerates the rotating-oscillating movement of the screw conveyor. The eccentricity of the rotating-oscillating movement is thus smaller than the width of the air gap, so that a contact and friction does not occur between the two coupling halves and the seal—which can be embodied again, for example in the form of a cylindrical air separating can between the coupling halves.

A further advantage of this eccentric screw pump lies in that the magnetic coupling and its absence of contact provides for a completely new drive concept because it is no longer necessary to connect the motor drive shaft to the wobbling screw conveyor so that the motor drive shaft runs completely smoothly.

In the case of this variation, the air gap can preferably also be penetrated by a seal, which hermetically separates the motor region from the rest of the eccentric screw pump, preferably in a contact-free manner.

The motor region is thus hermetically sealed, so that the fluid to be pumped cannot reach into the motor region and possible damages are prevented thereby.

This variation of the eccentric screw pump can preferably comprise characterizing features of the eccentric screw pump, which was described above first.

BRIEF DESCRIPTION OF THE DRAWINGS

The invention will be described on the basis of the following drawings.

DETAILED DESCRIPTION

Figure 1:
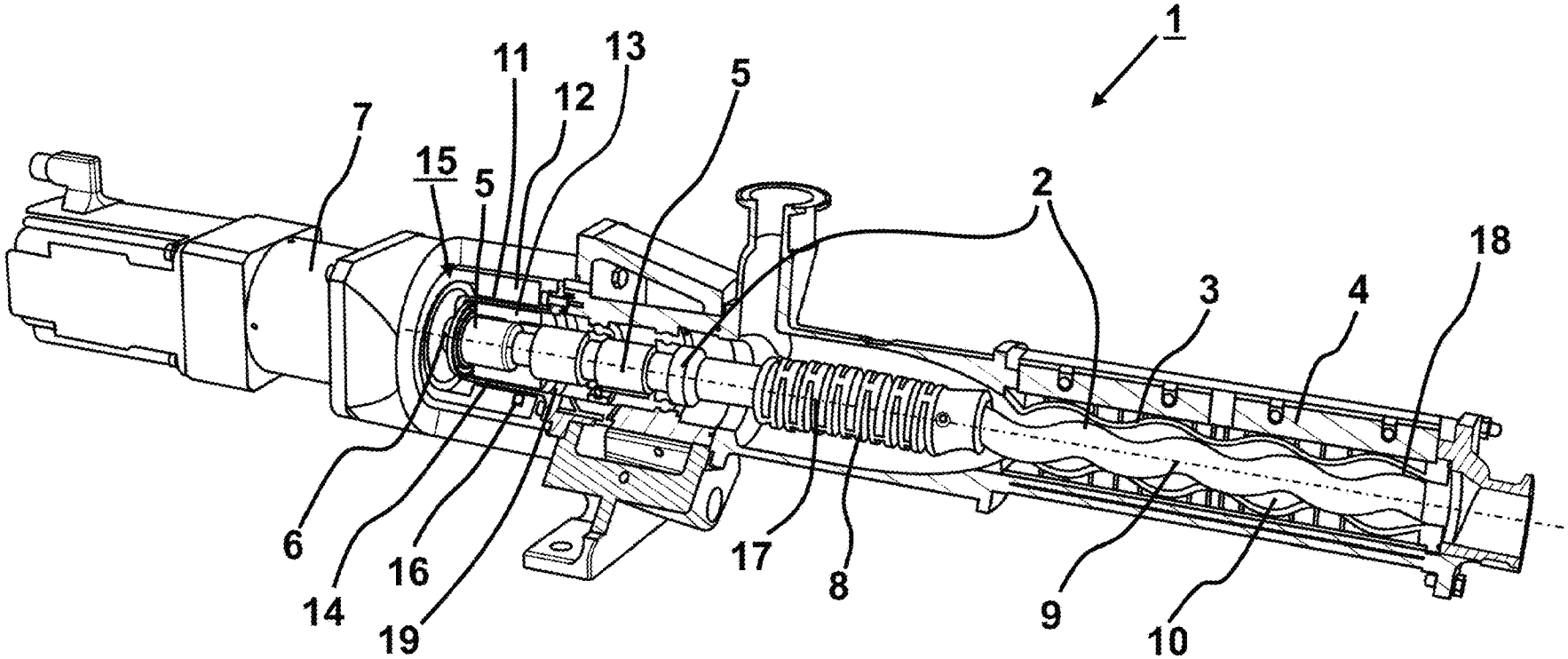
FIG. 1 shows an illustration of an eccentric screw pump.

FIG. 1 shows an illustration of an eccentric screw pump 1 with a rotor 2 of a pump drive shaft 5 circling essentially about a fixed axis relative to a stator 3 in a bearing block 4. It is rotationally driven by a motor drive shaft 6 of a motor 7. It is connected via a power train 8 to a screw conveyor 9, which revolves in a rotating-oscillating manner in a screw flight 10 of the stator 3.

The power train 8 thereby provides the screw conveyor 9 with its drive torque. Said power train has the function of adjusting the differences of the motion sequences of the screw conveyor 9 and of the pump drive shaft 5.

There is a gap referred to as air gap 11 between the motor drive shaft 6 and the pump drive shaft 5. The motor drive shaft 6 thereby supports a motor-side coupling half 12 and the pump drive shaft 5 supports a pump-side coupling half 13, which are connected to one another in a torque-transmitting manner by means of magnetic forces across the air gap 11. Said gap referred to ais air gap 11 is penetrated by a seal 14, which separates the motor region 15 of the motor 7 from the rest of the eccentric screw pump 1.

The seal 14 is embodied as a cylindrical air separating can, which is held on the bearing block with its open side. It forms a cavity, which protrudes beyond the bearing block and which receives the pump-side coupling half 13. The air separating can thus enlarges the installation space, which the bearing block forms.

The motor-side coupling half 12 and the pump-side coupling half 13 are designed and magnetically equipped so that they revolve synchronously with one another in the interference-free operation of the eccentric screw pump 1.

A thermal sensor 16 or another slip detector is provided in order to detect a slip between the two coupling halves 12 and 13. If such a slip occurs, an alarm could be triggered and/or slip-ending measures could additionally be initiated.

The eccentric screw pump 1 has a continuous, tubularly closed cooling duct 17, which reaches from a first region 18 with high pressure all the way into a second region 19 of the magnetic coupling with lower pressure, so that the higher pressure drives a flow of the pumped fluid from the first region with high pressure into the second region of the magnetic coupling with lower pressure. A cooling flow and/or cleaning flow is created thereby. The cooling duct 17 is illustrated by means of a dashed line.

Figure 2:
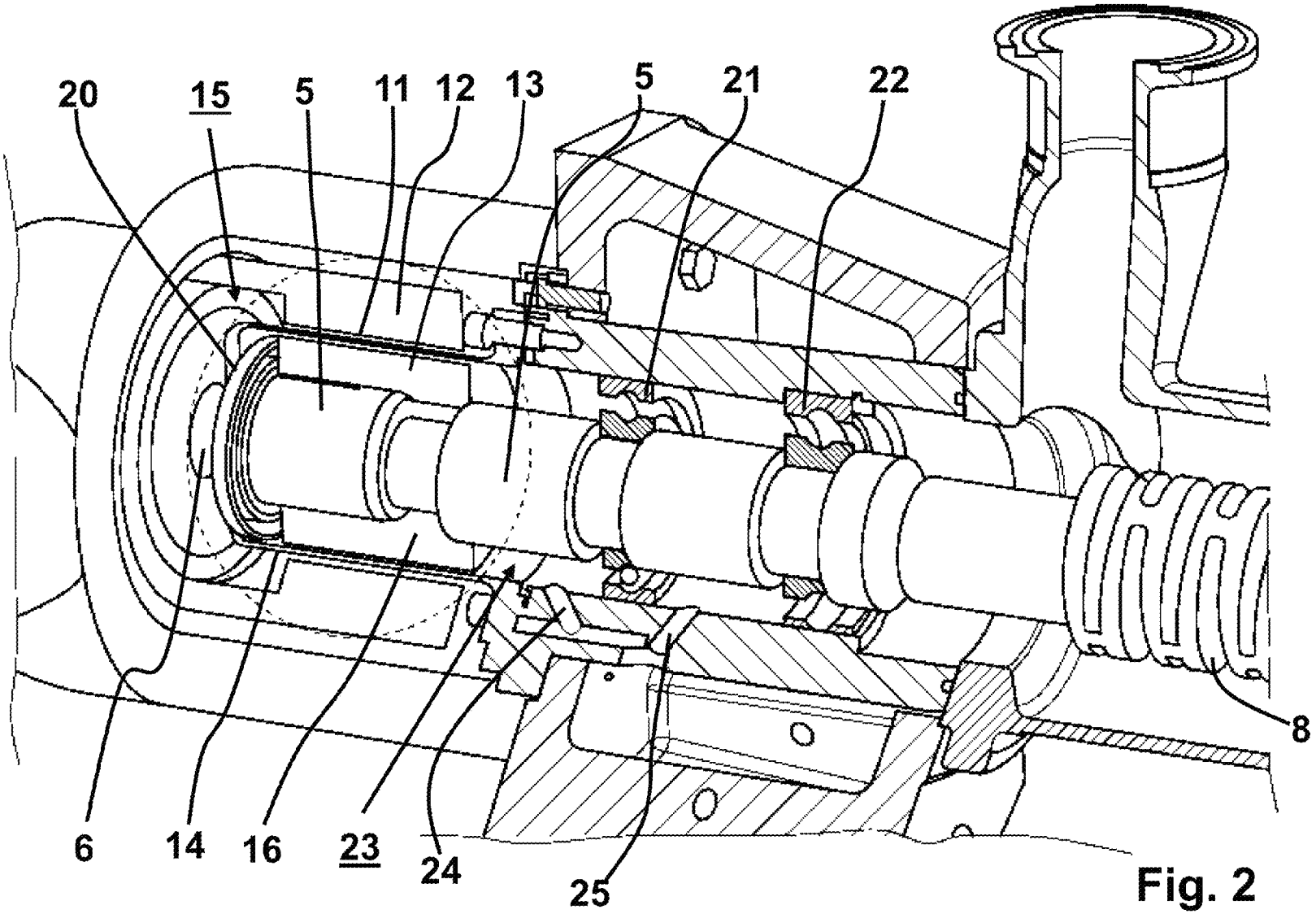
FIG. 2 shows a cutout of the eccentric screw pump from FIG. 1.

FIG. 2 shows a cutout of the eccentric screw pump 1 from FIG. 1, furthermore comprising a centrifugal pump wheel 20, which serves as pump means and drives a flow of the pumped fluid through the air gap 11. The pump-side coupling half 13 can thereby be cooled by means of the pumped fluid.

The pump drive shaft 5 is preferably supported on a first rolling bearing 21 and a second rolling bearing 22, wherein the rolling bearings 21 and 22 can be embodied as ceramic bearings, so that the service life is extended and the maintenance effort compared to metallic bearings is reduced.

In a drive region 23 there is arranged a first connection 24, via which an auxiliary fluid can be introduced and there is arranged a second connection 25, via which the auxiliary fluid can be discharged again in order to carry out a cleaning process. The drive region can be cleaned without disassembly thereby.

The two connections 24 and 25 can also be used in order to intake the pumped fluid within the drive region in order to build up an additional cooling flow.

Figure 3:
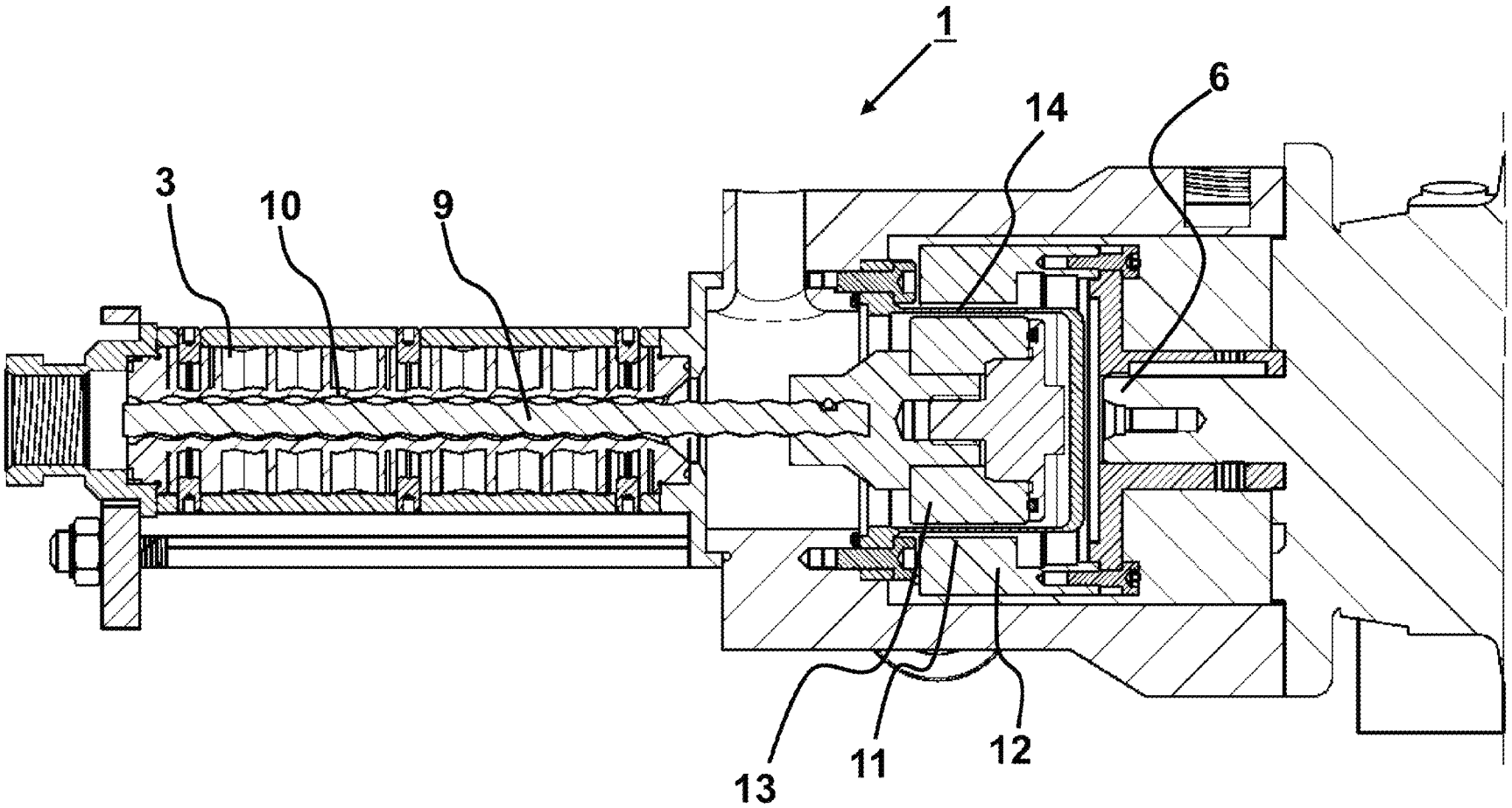
FIG. 3 shows a cross section of a further embodiment according to the invention of an eccentric screw pump.

FIG. 3 shows a cross section of a further embodiment according to the invention of an eccentric screw pump 1 with a screw conveyor 9, which is rotationally driven by a motor drive shaft 6 of a motor, and thereby revolves in a rotating-oscillating manner in a screw flight 10 of the stator 3.

The screw conveyor 9 is thereby connected directly, without a power train or another, e.g., cardanically-acting intermediate member, which thus ensures kinematic adjustment, to a pump-side coupling half 13. The latter cooperates with a motor-side coupling half 12.

In light of the foregoing, the two coupling halves 12 and 13 are connected to one another in a torque-transmitting manner by means of magnetic forces across an air gap 11 separating them permanently (according to the above definition). The air gap 11 is thereby formed and dimensioned so that it tolerates the rotating-oscillating movement, which the screw conveyor 9 impresses upon the pump-side coupling half 13. The eccentricity of the rotating-oscillating movement is therefore smaller than the width of the air gap 11, so that a local dropping of the air gap to "zero" does not occur.

The air gap is preferably penetrated by a seal 14 in the form of a cylindrical air separating can. The motor region is then hermetically separated from the rest of the eccentric screw pump 1.

Figure 4:
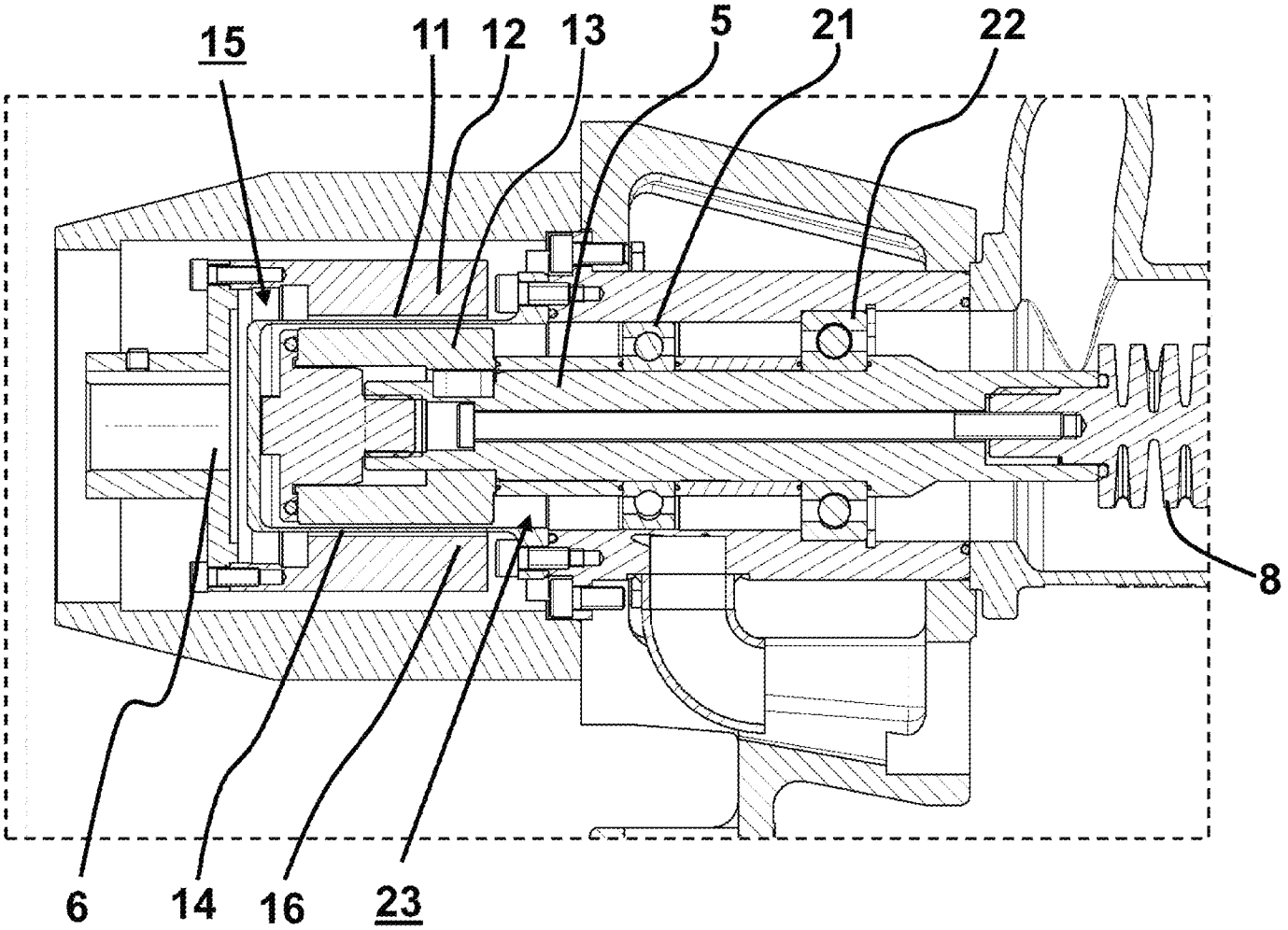
FIG. 4 shows a cutout of a further embodiment according to the invention in cross section.

FIG. 4 additionally shows a cutout of a further embodiment according to the invention in cross section, wherein a preferred arrangement of the individual parts can be seen here in the cross section of all parts.

The invention claimed is:

1. An eccentric screw pump comprising:

a rotor of a pump drive shaft circling about a fixed axis relative to a stator in a bearing block, the pump drive shaft being rotationally driven by a motor drive shaft of a motor, a power train, and a screw conveyor, which revolves in a rotating-oscillating manner in a screw flight of the stator, wherein the power train provides the screw conveyor with drive torque, and the power train adjusts differences of motion sequences of the screw conveyor and of the pump drive shaft, wherein the eccentric screw pump includes an air gap between the motor drive shaft and the pump drive shaft, wherein the motor drive shaft supports a motor-side coupling half and the pump drive shaft supports a pump-side coupling half, which are connected to one another in a torque-transmitting manner by means of magnetic forces across the air gap, and wherein the air gap is penetrated by a seal, which hermetically separates a motor region from the rest of the eccentric screw pump, and wherein the bearing block or drive region has at least one connection configured to introduce an auxiliary fluid, and at least one further connection configured to discharge the auxiliary fluid.

2. The eccentric screw pump according to claim 1, wherein the seal is embodied as a cylindrical air separating can, wherein the cylindrical air separating can has an open side that is held on the bearing block, and wherein the cylindrical air separating can forms a cavity, which protrudes beyond the bearing block and which receives the pump-side coupling half.

3. The eccentric screw pump according to claim 2, wherein the motor-side coupling half and the pump-side coupling half are designed and are equipped magnetically in such a way that they revolve synchronously with one another in an interference-free operation of the eccentric screw pump.

4. The eccentric screw pump according to claim 2, wherein the pump-side coupling half is cooled by a fluid pumped by the eccentric screw pump.

5. The eccentric screw pump according to claim 1, wherein the motor-side coupling half and the pump-side coupling half are designed and are equipped magnetically in such a way that they revolve synchronously with one another in an interference-free operation of the eccentric screw pump.

6. The eccentric screw pump according to claim 5, further comprising a thermal sensor or a slip detector, which triggers an alarm and/or takes slip-ending measures, as soon as slip occurs between the coupling halves.

7. The eccentric screw pump according to claim 1, wherein the pump-side coupling half is cooled by a fluid pumped by the eccentric screw pump.

8. The eccentric screw pump according to claim 7, wherein the pump drive shaft supports a pump means, which drives a flow through the air gap.

9. The eccentric screw pump according to claim 8, characterized in that the pump drive shaft supports the pump means on a front end region of the pump drive shaft facing away from the screw conveyor.

10. The eccentric screw pump according to claim 9, wherein the pump means is a centrifugal pump wheel.

11. The eccentric screw pump according to claim 7, wherein the pump drive shaft is supported on rolling bearings.

12. The eccentric screw pump according to claim 7, further comprising a continuous, tubularly closed cooling duct, which reaches from a high pressure region all the way into a region of a magnetic coupling with lower pressure, so that the higher pressure drives a flow of the pumped fluid from the high pressure region into the region of the magnetic coupling, wherein the region of the magnetic coupling is arranged at the coupling halves.

13. The eccentric screw pump according to claim 1, wherein a region of the bearing block guiding the auxiliary fluid is separated from a region guiding fluid to be pumped via a contact seal.

14. The eccentric screw pump according to claim 1, wherein the auxiliary fluid is supplied to the bearing block or the drive region and/or is guided in the bearing block or the drive region, so as to be cleaned without disassembly.

* * * * *